US005675859A

United States Patent [19]

Barre

[11] Patent Number: 5,675,859

[45] Date of Patent: Oct. 14, 1997

[54] TOOTHBRUSH ASSEMBLY

[75] Inventor: Betrand Dominique Joseph Barre, Lyon-Limonest, France

[73] Assignee: Chesebrough-Pond's USA Co., Division of Conopco, Inc., Greenwich, Conn.

[21] Appl. No.: 479,482

[22] Filed: Jun. 7, 1995

[51] Int. Cl.[6] ..... A46B 9/04

[52] U.S. Cl. ..... 15/167.1; 15/143.1; 15/257.01; 132/308; 248/111; 248/908; D4/107; D4/108; D6/534

[58] Field of Search ..... 15/167.1, 143.1, 15/146, 246, 257.01; 132/308; 211/65; 248/110, 111, 519, 908, 915, 523; D4/107, 108, 124–126, 199; D6/528, 534

[56] References Cited

U.S. PATENT DOCUMENTS

| | | | |
|---|---|---|---|
| D. 209,574 | 12/1967 | Zandberg et al. | D4/107 |
| D. 279,248 | 6/1985 | Oliver | D6/534 |
| 1,618,027 | 2/1927 | Vogler | 211/65 |
| 1,847,253 | 3/1932 | Munro | 248/110 |
| 2,539,035 | 1/1951 | Scanlon et al. | 248/110 |
| 3,138,813 | 6/1964 | Kaplan | 15/22.1 |
| 3,170,265 | 2/1965 | Goldfarb | D6/534 |
| 3,178,060 | 4/1965 | Bossack | 222/78 |
| 4,979,708 | 12/1990 | Aoki | 248/110 |
| 5,187,829 | 2/1993 | Atkins | 15/167.1 |
| 5,269,420 | 12/1993 | Harrison | 206/362.3 |
| 5,369,835 | 12/1994 | Clarke | 15/167.1 |

FOREIGN PATENT DOCUMENTS 676 939 6/1939 Germany .

*Primary Examiner*—Gary K. Graham
*Attorney, Agent, or Firm*—Milton L. Honig

[57] ABSTRACT

A toothbrush assembly is provided with a toothbrush and a stand for releasably retaining the toothbrush in a vertical position, the combination resembling a human or cartoon caricature. The toothbrush includes head, neck, shoulder and torso sections, the latter serving as a user handle. The shoulder section has rounded sides which serve as support points and are snappingly received within the collar portion of the stand. Left and right arms project from either side of the collar portion and include a caricatured hand for each. A foot is formed as a flat platform serving as the base of the stand. A vertically erected post connects the collar portion to the foot.

10 Claims, 2 Drawing Sheets

TOOTHBRUSH ASSEMBLY

BACKGROUND OF THE INVENTION

1. Field of the Invention

The invention relates to a toothbrush assembly which may have particular appeal to children, and therefore may be of use in promoting generally improved dental health.

2. The Related Art

Toothbrushes are the frontline weapons in the war against dental disease. Typically, the toothbrush is constructed from an elongated handle designed to be comfortably held in the hand and a head portion with a plurality of tufts of bristles. Cleaning is achieved by maneuvering the bristles along teeth and gum lines in a user's mouth.

It has long been appreciated that a toothbrush should desirably be permitted to dry as fast as possible. Growth of undesirable microorganisms on the brush can be retarded by eliminating the wet environment.

Horizontal drying occurs when the brush is left with the bristles pointing upright and lying along its length on a flat surface. Drying in the horizontal position may facilitate flow to the tuft holes of any water retained on the bristles. It is relatively difficult for water to evaporate when trapped in the tuft holes. Accumulation of trapped water may facilitate the aforementioned undesirable microbial growth.

Vertical drying is another option. Here the toothbrush is supported in its substantially upright position. Drainage and evaporation of water best occurs in the vertical arrangement. Unfortunately, most users do not appreciate the advantages of the vertical upright position. Especially when the users are children, there is even less likelihood than with adults for concern with undesirable microbial growth.

A number of patents have disclosed holders for uprightly storing a toothbrush. For instance, U.S. Pat. Des. 279,248 (Oliver) illustrates a four-brush holder having a Superman facade. U.S. Pat. No. 3,138,813 (Kaplan) discloses an upright toothbrush held within a caricatured mechanically vibratable holder. U.S. Pat. No. 3,170,265 (Goldfarb) describes an animated toothbrush holder in the form of a rabbit. U.S. Pat. No. 3,178,060 (Bossack) discloses a vertically supported collapsible toothpaste tube hidden under a clown figurine, the latter having hands restraining a vertically oriented toothbrush. U.S. Pat. No. 2,539,035 (Scanlon et al.) describes a piggy bank in the form of a toothbrush holder, the brush being released only on insertion of a coin to activate a releasing lever. U.S. Pat. No. 5,187,829 (Atkins) discloses a menagerie of animal shaped toothbrush handles. U.S. Pat. Des. 209,574 (Zanberg et al.) illustrates an upright standing caricature toothbrush, but no separate holder. More basic toothbrush stands for vertical support are reported in U.S. Pat. No. 1,618,027 (Vogler) and German Patent 676 939 (Meese-Marktscheffel).

None of the aforementioned patents disclose a combined toothbrush and holder wherein both parts are necessary in providing the illusion of a caricature, an aspect especially important to children. Most of the described patents also require the toothbrush end to be held within an aperture of the holder. Drainage of water is thereby hindered.

Accordingly, it is an object of the present invention to provide a toothbrush in the context of an assembly which encourages a user to allow the toothbrush to dry in the vertical upright position.

Another object of the present invention is to provide a toothbrush assembly which minimizes microbial growth.

Still another object of the present invention is to provide an assembly, especially for children, which through the appeal of a caricature motivates use of a toothbrush.

These and other objects of the present invention will become more readily apparent from consideration of the following summary, drawing and detailed description.

SUMMARY OF THE INVENTION

Now a toothbrush assembly has been developed wherein both a toothbrush and its holding stand in combination form a caricature image. Adults and especially children are thereby induced not only to brush but to replace the toothbrush in its most hygienically upright storage position. Water drainage is facilitated and microorganism growth inhibited.

A toothbrush assembly is provided that includes:

a toothbrush including:

a head having a major surface from which tufts of bristles project outwardly;

a shoulder section having rounded sides with a diameter thereacross;

a neck section connecting the head to the shoulder section and having a smaller diameter than the diameter across the rounded sides of the shoulder section;

a torso section serving as a user handle, lying along a longitudinal axis, the torso section having a first and second end, the first end being attached to the shoulder section, the torso section being defined by a front, a rear and a pair of side surfaces, the side surfaces being interposed between the front and rear surfaces, the front surface of the torso section and the major surface of the head facing in an identical direction;

a stand for releasably retaining the toothbrush, the stand having a first and second terminus and including:

a collar portion at the first terminus supporting the toothbrush along the rear and side surfaces of the shoulder, the front surface remaining clear of any collar portion support;

left and right arms each with a first and second end opposite one another, a caricature hand for each of the arms being attached to the second end, each of the arms being connected by their first ends to the collar portion;

a foot formed as a flat platform horizontal to an exterior surface upon which the stand rests; and a vertically erect post connecting the collar portion to the foot.

The stand part of the assembly should be capable of supporting itself on a substantially horizontal surface. Mounting of the stand, for example by being attached to a wall, is rendered unnecessary. Preferably the stand will be constructed integrally as a unitarily molded plastic piece.

In its most preferred embodiment, the stand is shaped so as to be both functional and provide amusement for children. An overall appearance of shoulders, arms, hands and feet are provided by the stand. Head, neck and torso are illusions created by the toothbrush structure. Resemblance of the caricature is intended to be that of a man or a cartoon character.

Promotion of the caricature is assisted by the torso section of the toothbrush tapering ever increasingly outward along its length from the first to the second end thereof. Moreover, the neck is preferably curved concavely away from the longitudinal axis of the torso section. Curvature allows the head to tilt slightly downward not only reinforcing its relationship to the torso but functionally being arranged at a better brushing angle with respect to the molar teeth. The ball-like shoulder section of the toothbrush functions cooperatively with the collar portion of the stand serving as the stand's main point of support for the toothbrush. On an interior surface, the collar portion has curvature sufficient to snappingly receive the shoulder section in ball-socket fashion.

A number of features on the stand contribute to the caricature and functional aspects. The foot is constructed to be a solid sturdy support for the stand as it rests on a bathroom surface. Symmetrical left and right shoe portions are formed on the foot. These shoe portions are oriented outwardly away from one another. This arrangement has the functional advantage of providing lateral stability.

Left and right arms each may be provided with an upper and a lower portion angularly joined at an elbow. The angle of joinder may be different for the respective left and right arms. In the preferred embodiment, one angle of joinder is obtuse while the other is acute.

The caricatured hand at the second end of each of the arms is preferably molded with a plurality of fingers. In the most preferred embodiment there are four fingers on each hand, the orientation of fingers on the left and right hands being different.

The arms and their associated hands are arranged on flanking sides of the stand with a functional intent to provide lateral balance and therefore are not merely ornamental in nature.

BRIEF DESCRIPTION OF THE DRAWING

The above objects, features and advantages of the present invention will more fully be appreciated through the following detailed discussion, reference being made to the drawing consisting of.

DETAILED DESCRIPTION

Figure 1:
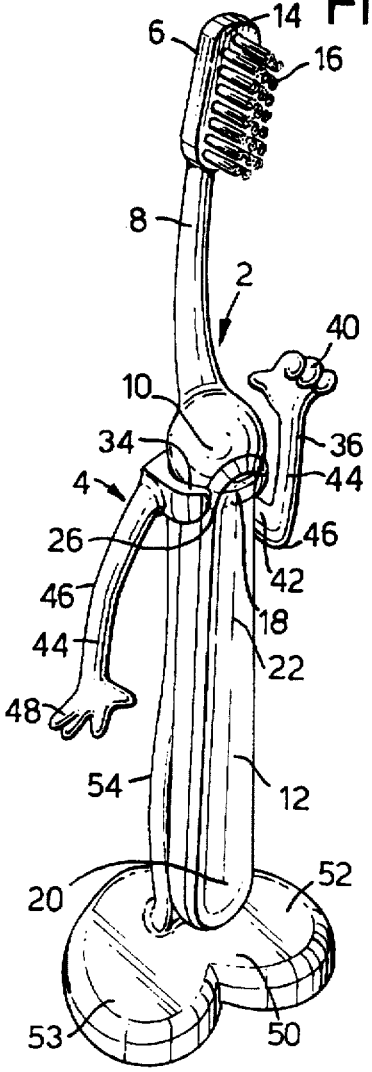
FIG. 1 which is a front perspective view of the assembly according to the present invention.
Figure 2:
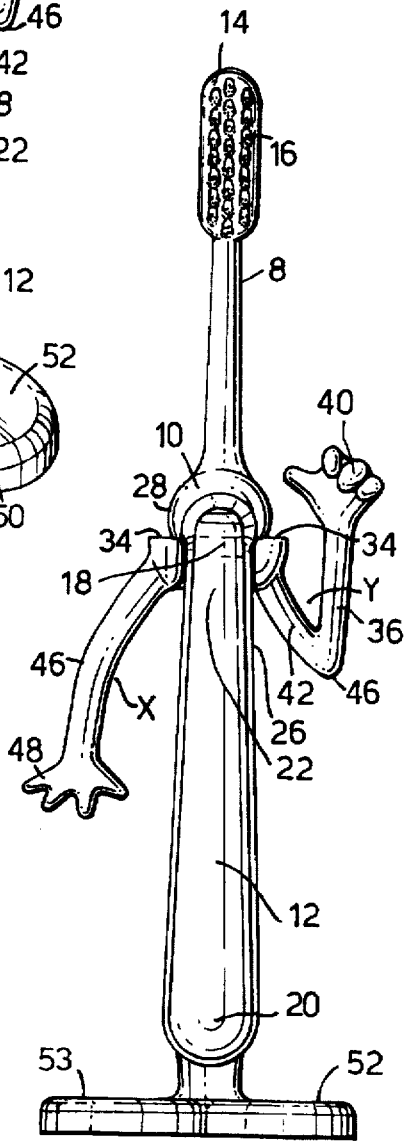
FIG. 2 which is a front elevational view of the embodiment according to FIG. 1.
Figure 3:
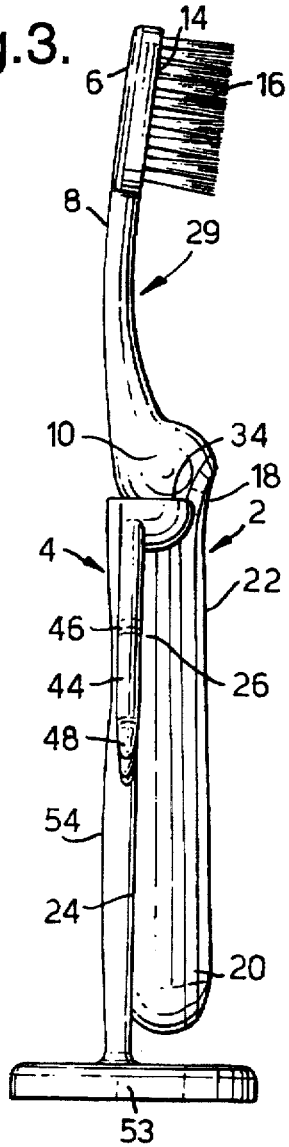
FIG. 3 which is a side elevational view of the embodiment according to FIG. 1.
Figure 4:
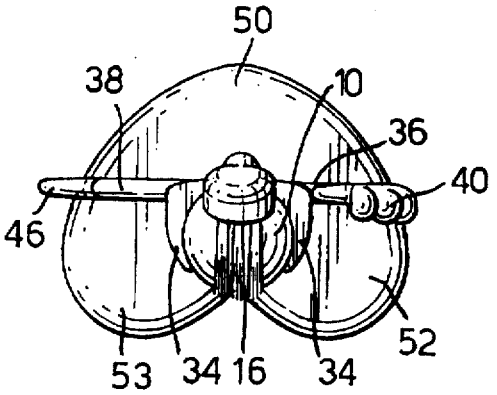
FIG. 4 which is a top elevational view of the embodiment according to FIG. 1.
Figure 5:
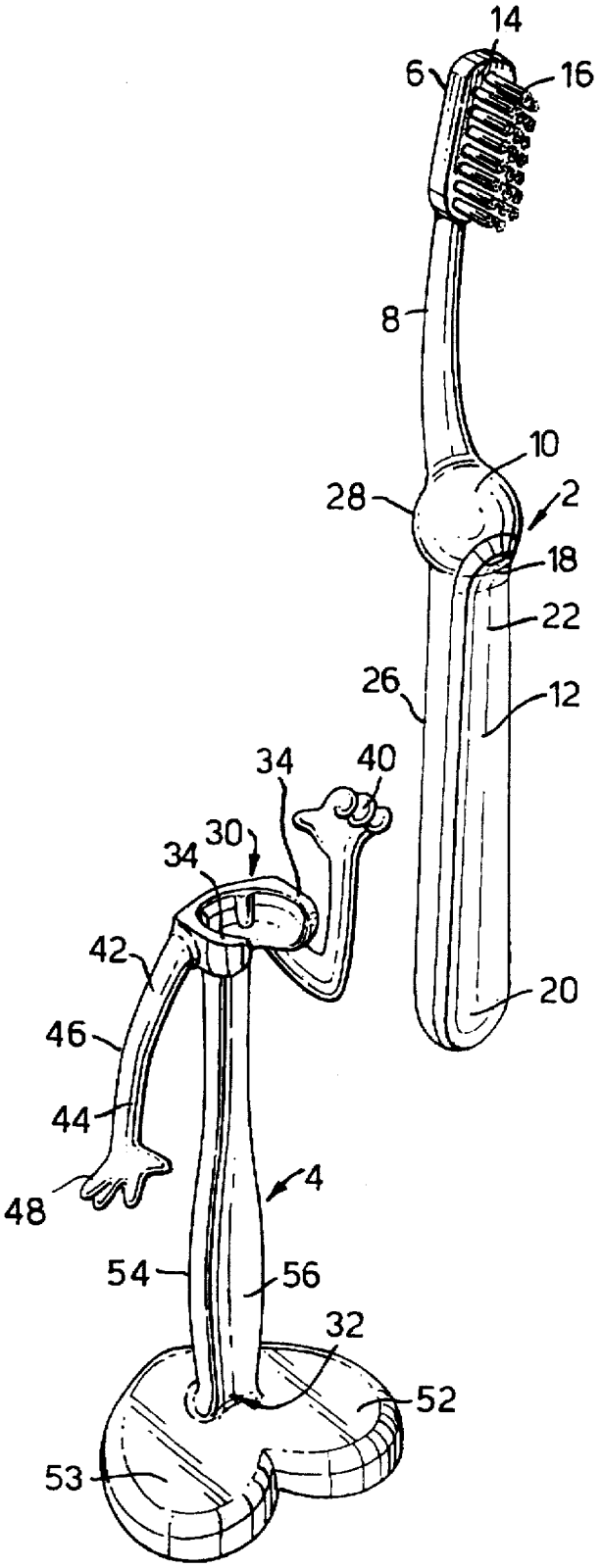
FIG. 5 which is identical to FIG. 1 except showing the toothbrush separated from its stand.

A preferred embodiment of the toothbrush assembly according to the present invention is shown in FIGS. 1–5. The assembly includes a toothbrush 2 and a stand 4, the latter releasably retaining the toothbrush and supporting it for storage in a vertical upright position.

Toothbrush 2 includes a head 6, a neck section 8, a shoulder section 10 and a torso section 12. Head 6 is provided on a major surface 14 thereof with tufts of bristles 16 projecting outwardly orthogonal to surface 14. Neck section 8 is positioned between head 6 and shoulder section 10. Torso section 12 lies along a longitudinal axis L and has a first and second end 18, 20. First end 18 of the torso section is connected to the shoulder section 10. The torso section is further defined by a front surface 22, a rear surface 24 and a pair of side surfaces 26. The side surfaces 26 are interposed between the front and rear surfaces 22, 24. Front surface 22 and the major surface 14 of the head are arranged to face in an identical direction.

Shoulder section 10 is formed with rounded sides 28, the major diameter across the hip being larger than a diameter across the first end 18 of the torso section.

Neck section 8 is curved concavely 29 away from the longitudinal axis L of the torso section 12. Curvature of the neck allows the head 6 to tilt downwardly seemingly interacting with the shoulder section, torso section and arms thereby providing a human-like illusion.

Stand 4 extends from a terminus 30 to a second terminus 32. The stand includes a collar portion 34 at the first terminus 30 for supporting the toothbrush along its rear and side surfaces 24, 26. When arranged on the stand, the toothbrush on its front surface 22 remains clear of any collar portion support. Collar portion 34 on its inner surface has a curvature to snap-fit over the rounded sides of the shoulder section.

Also included as part of the stand are left and right arms 36, 38 each with a first and second end opposite one another. A caricatured hand 40 is attached at the second end of each of the arms. Attachment of the arms to the collar portion occurs at the first end.

Left and right arms are each formed with upper and lower portions 42, 44 angularly joined at an elbow 46. Joinder on the left arm is at an acute angle Y. The joinder on the right arm is at an obtuse angle X.

Hand 40 features four fingers 48. The fingers of the hand on the left arm are oriented differently from those of the hand on the right arm.

Stand 4 also includes a foot 50 formed as a flat platform horizontal to an exterior surface upon which the stand rests. For broadest support, foot 50 includes a left and a right shoe 52, 53.

A vertically erected post 54 connects the collar portion 34 to the foot 50. All of the stand can be molded from a unitary piece of plastic. A front face 56 of the post is concavely molded to form-fittingly accommodate rear surface 24 of the toothbrush.

In the featured embodiment, the stand with particular emphasis on the collar portion, post and foot/shoes have specifically been constructed to ensure that the center of gravity of the assembled toothbrush with stand is located in such a position that the assembly is stable and does not topple easily.

The foregoing illustrates only a select embodiment of the present invention. Numerous modifications and changes are expected to readily occur to those skilled in the art, all of which fall within the purview and scope of the present invention.

What is claimed is:

1. A toothbrush assembly comprising:

a toothbrush that comprises:

a head having a major surface from which tufts of bristles project outwardly;

a shoulder section having rounded side surfaces with a diameter thereacross a front surface and a rear surface;

a neck section connecting the head to the shoulder section and having a smaller diameter than the diameter across the rounded side surface of the shoulder section;

a torso section serving as a user handle, lying along a longitudinal axis, the torso section having a first and second end, the first end being attached to the shoulder section, the torso section being defined by a front, a rear and a pair of side surfaces, the side surfaces being interposed between the front and rear surfaces, the front surface of the torso section and the major surface of the head facing in an identical direction;

a stand for releasably retaining the toothbrush, the stand having a first and second terminus and comprising:

a collar portion having first and second free end portions, said collar portion provided at the first terminus supporting the toothbrush along the rear and side surfaces of the shoulder, the front surface thereof remaining clear of any collar portion support;

left and right arms each with a first and second end opposite one another, a caricature hand for each of the arms being attached to the second end, each of the arms being connected by their first ends to the collar portion;

a foot formed as a flat platform horizontal to an exterior surface upon which the stand rests; and a vertically erect post connecting the collar portion to the foot.

2. A toothbrush assembly according to claim 1 wherein the torso section tapers ever increasingly outward along its length from the first to the second end.

3. A toothbrush assembly according to claim 1 wherein the foot is formed with symmetrical left and right shoe portions.

4. A toothbrush assembly according to claim 3 wherein the shoe portions are oriented outwardly away from one another.

5. A toothbrush assembly according to claim I wherein the neck section is curved concavely away from the longitudinal axis of the torso portion.

6. A toothbrush assembly according to claim 1 wherein the arms each have an upper and a lower portion angularly joined at an elbow.

7. A toothbrush assembly according to claim 6 wherein the angle of joinder is different for the respective left and right arms.

8. A toothbrush assembly according to claim 7 wherein one angle of joinder is obtuse and the other acute.

9. A toothbrush assembly according to claim 1 wherein each hand has a plurality of fingers.

10. A toothbrush assembly according to claim 9 wherein the fingers on each hand are four in number.

* * * * *